US006811683B2

(12) United States Patent
Davis et al.

(10) Patent No.: US 6,811,683 B2
(45) Date of Patent: Nov. 2, 2004

(54) PRODUCTION OF DIESEL FUEL FROM BITUMEN

(75) Inventors: Stephen Mark Davis, Stewartsville, NJ (US); Michael Gerard Matturro, Lambertville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 572 days.

(21) Appl. No.: 09/818,439

(22) Filed: Mar. 27, 2001

(65) Prior Publication Data

US 2002/0170228 A1 Nov. 21, 2002

(51) Int. Cl.[7] ..... C10G 67/00

(52) U.S. Cl. ..... 208/97; 208/390; 208/177; 208/209

(58) Field of Search ..... 208/97, 177, 209, 208/390

(56) References Cited

U.S. PATENT DOCUMENTS 6,540,023 B2 * 4/2003 Davis et al. ..... 166/303

* cited by examiner

*Primary Examiner*—Walter D. Griffin
*Assistant Examiner*—James Arnold, Jr.
(74) *Attorney, Agent, or Firm*—Edward M. Corcoran; Mark D. Martin

(57) ABSTRACT

A process for producing a diesel fuel stock from bitumen uses steam and a hydroisomerized diesel fraction produced by a gas conversion process, to respectively stimulate the bitumen production and increase the cetane number of a hydrotreated diesel fuel fraction produced by upgrading the bitumen, to form a diesel stock. The diesel stock is used for blending and forming diesel fuel.

20 Claims, 3 Drawing Sheets

PRODUCTION OF DIESEL FUEL FROM BITUMEN

BACKGROUND OF THE DISCLOSURE

1. Field of the Invention

The invention relates to an integrated process for producing diesel fuel from bitumen and hydrocarbons synthesized from natural gas. More particularly, the invention relates to an integrated process in which a natural gas conversion process produces steam, a high cetane number diesel fraction and hydrogen, wherein the steam is used for bitumen production, the hydrogen is used for bitumen conversion and the diesel fraction is blended with a low cetane number diesel fraction produced from the bitumen.

2. Background of the Invention

Very heavy crude oil deposits, such as the tar sand formations found in places like Canada and Venezuela, contain trillions of barrels of a very heavy, viscous petroleum, commonly referred to as bitumen. The bitumen has an API gravity typically in the range of from 5° to 10° and a viscosity, at formation temperatures and pressures that may be as high as a million centipoise. The hydrocarbonaceous molecules making up the bitumen are low in hydrogen and have a resin plus asphaltenes content as high as 70%. This makes the bitumen difficult to produce, transport and upgrade. Its viscosity must be reduced in-situ underground for it to be pumped out (produced); it needs to be diluted with a solvent if it is to be transported by pipeline, and its high resin and asphaltene content tends to produce hydrocarbons low in normal paraffins. Underground bitumen is generally produced by steam stimulation, in which hot steam is injected down into the formation to lower the viscosity of the oil sufficient to pump it out of the ground. This is disclosed, for example, in U.S. Pat. No. 4,607,699. In U.S. Pat. No. 4,874,043 a method is disclosed in which both hot steam and hot water are alternately pumped into the ground. A significant requirement of steam stimulated bitumen production is a source of readily available steam, most of which is lost or consumed in the process and cannot be recovered. As a consequence of the relatively low hydrogen content of the bituminous molecules, diesel fuel produced by coking and hydrotreating bitumen tends to be low in cetane number. Hence, when bitumen diesel production is desired, a higher cetane hydrocarbon blending component is needed to mix with the lower cetane bitumen diesel.

Gas conversion processes, which produce hydrocarbons from a synthesis gas derived from natural gas, are well known. The synthesis gas comprises a mixture of $H_2$ and CO, which are reacted in the presence of a Fischer-Tropsch catalyst to form hydrocarbons. Fixed bed, fluid bed and slurry hydrocarbon synthesis processes have been used, all of which are well documented in various technical articles and in patents. Both light and heavy hydrocarbons may synthesized, including diesel fractions relatively high in cetane number. In addition to hydrocarbon production, these processes also produce steam and water. It would be an improvement to the art if bitumen production and gas conversion could be integrated, to utilize features of the gas conversion process to enhance bitumen production and products and produce a diesel fuel fraction having a cetane number higher than is obtained just from bitumen.

SUMMARY OF THE INVENTION

The invention relates to a process in which natural gas is converted to a synthesis gas feed, from which liquid hydrocarbons, including a diesel fraction are synthesized and steam is generated, to facilitate bitumen production improve the cetane number of diesel produced from the bitumen. The conversion of natural gas to synthesis gas and the synthesis or production of hydrocarbons from the synthesis gas will hereinafter be referred to as "gas conversion". The natural gas used to produce the synthesis gas will typically and preferably come from the bitumen field or a nearby gas well. The gas conversion process produces liquid hydrocarbons, including a diesel fraction, steam and water. The steam is used to stimulate the bitumen production and the higher cetane number gas conversion diesel is blended with the lower cetane number bitumen diesel, to produce a diesel fuel stock. Thus, the invention broadly relates to an integrated gas conversion and bitumen production and upgrading process, in which gas conversion steam and diesel fraction hydrocarbon liquids are respectively used to stimulate bitumen production and upgrade a bitumen-derived diesel fraction. The conversion of natural gas to a synthesis gas is achieved by any suitable synthesis gas process.

The hydrocarbons are synthesized from synthesis gas that comprises a mixture of $H_2$ and CO. This gas is contacted with a suitable hydrocarbon synthesis catalyst, at reaction conditions effective for the $H_2$ and CO in the gas to react and produce hydrocarbons, at least a portion of which are liquid and include a diesel fraction. It is preferred that the synthesized hydrocarbons comprise mostly paraffinic hydrocarbons, to produce a diesel fraction high in cetane number. This may be achieved by using a hydrocarbon synthesis catalyst comprising a cobalt and/or ruthenium, and preferably a cobalt catalytic component. At least a portion of the gas conversion synthesized diesel fraction is upgraded by hydroisomerization to lower its pour and freeze points. The higher boiling diesel hydrocarbons (e.g., 500–700° F.) are highest in cetane number and are preferably hydroisomerized under mild conditions, to preserve the cetane number. The gas conversion portion of the process produces high and medium pressure steam, all or a portion of which are injected into the ground to stimulate the bitumen production. Water is also produced by the hydrocarbon synthesis reaction, all or a portion of which may be heated to produce steam for the bitumen production, for utilities or both. Thus, by "gas conversion steam" or "steam obtained or derived from a gas conversion process" in the context of the invention is meant to include any or all of the (i) high and medium pressure steam produced by the gas conversion process and (ii) steam produced from heating the hydrocarbon synthesis reaction water, and any combination thereof. Still further, a methane rich tail gas is also produced by the gas conversion process and may be used as fuel, including fuel for utilities and to produce steam from the synthesis reaction water and/or further heat the gas conversion steam. By bitumen production is meant steam stimulated bitumen production, in which steam is injected down into a bitumen formation, to soften the bitumen and reduce its viscosity, so that it can be pumped out of the ground.

Upgrading comprises fractionation and one or more conversion operations. By conversion is meant at least one operation in which at least a portion of the molecules is changed and which may or may not include hydrogen as a reactant. If hydrogen is present as a reactant it is broadly referred to as hydroconversion. For the bitumen, conversion includes cracking, which may be coking (non-catalytic) or catalytic cracking, as well as hydroconversion, as is known and explained in more detail below. In another embodiment of the invention, hydrogen useful for converting the synthesized hydrocarbons is produced from the synthesis gas generated in the gas conversion portion of the process. The hydrocarbon synthesis also produces a tail gas that contains methane and unreacted hydrogen. In a further embodiment, this tail gas may be used as fuel to produce steam for bitumen production, pumps or other process utilities.

The process of the invention briefly comprises (i) stimulating the production of bitumen with steam obtained from a natural gas fed gas conversion process that produces a diesel hydrocarbon fraction and steam, (ii) converting the bitumen to form lower boiling hydrocarbons, including a diesel fraction, and (iii) forming a mixture of the gas conversion and bitumen diesel fractions. In a more detailed embodiment the invention comprises the steps of (i) producing bitumen with steam stimulation, (ii) upgrading the bitumen to lower boiling hydrocarbons, including a sulfur-containing bitumen diesel fraction, (iii) treating the bitumen diesel fraction to reduce its sulfur content, (iv) producing steam and hydrocarbons, including a diesel fraction, by means of a natural gas fed gas conversion process, wherein at least a portion of the steam is used for the bitumen production, and (v) treating at least a portion of the gas conversion diesel fraction to reduce its pour point. At least a portion of both treated diesel fractions are then blended to form a diesel stock. In a still more detailed embodiment the process of the invention comprises:

(i) converting natural gas to a hot synthesis gas comprising a mixture of $H_2$ and CO which is cooled by indirect heat exchange with water to produce steam;

(ii) contacting the synthesis gas with a hydrocarbon synthesis catalyst in one or more hydrocarbon synthesis reactors, at reaction conditions effective for the $H_2$ and CO in the gas to react and produce heat, liquid hydrocarbons including a diesel fuel fraction, and a gas comprising methane and water vapor;

(iii) removing heat from the one or more reactors by indirect heat exchange with water to produce steam;

(iv) hydroisomerizing at least a portion of the diesel fraction to reduce its pour point;

(v) passing at least a portion of the steam produced in either or both steps (i) and (iii) into a tar sand formation to heat soak and reduce the viscosity of the bitumen;

(vi) producing the bitumen by removing it from the formation;

(vii) upgrading the bitumen to lower boiling hydrocarbons, including a diesel fuel fraction containing heteroatom compounds;

(viii) hydrotreating the bitumen diesel fuel fraction to reduce its heteroatom content, and (ix) combining at least a portion of each of the treated diesel fuel fractions.

The hydrotreating also reduces the amount of unsaturated aromatic and metal compounds. By bitumen diesel fraction referred to above is meant a diesel fuel fraction produced by upgrading the bitumen including coking and fractionation. The tar sand formation is preferably an underground or subterranean formation having a drainage area penetrated with at least one well, with the softened and viscosity-reduced bitumen produced by removing it from the formation up through the well.

DETAILED DESCRIPTION

Figure 1:
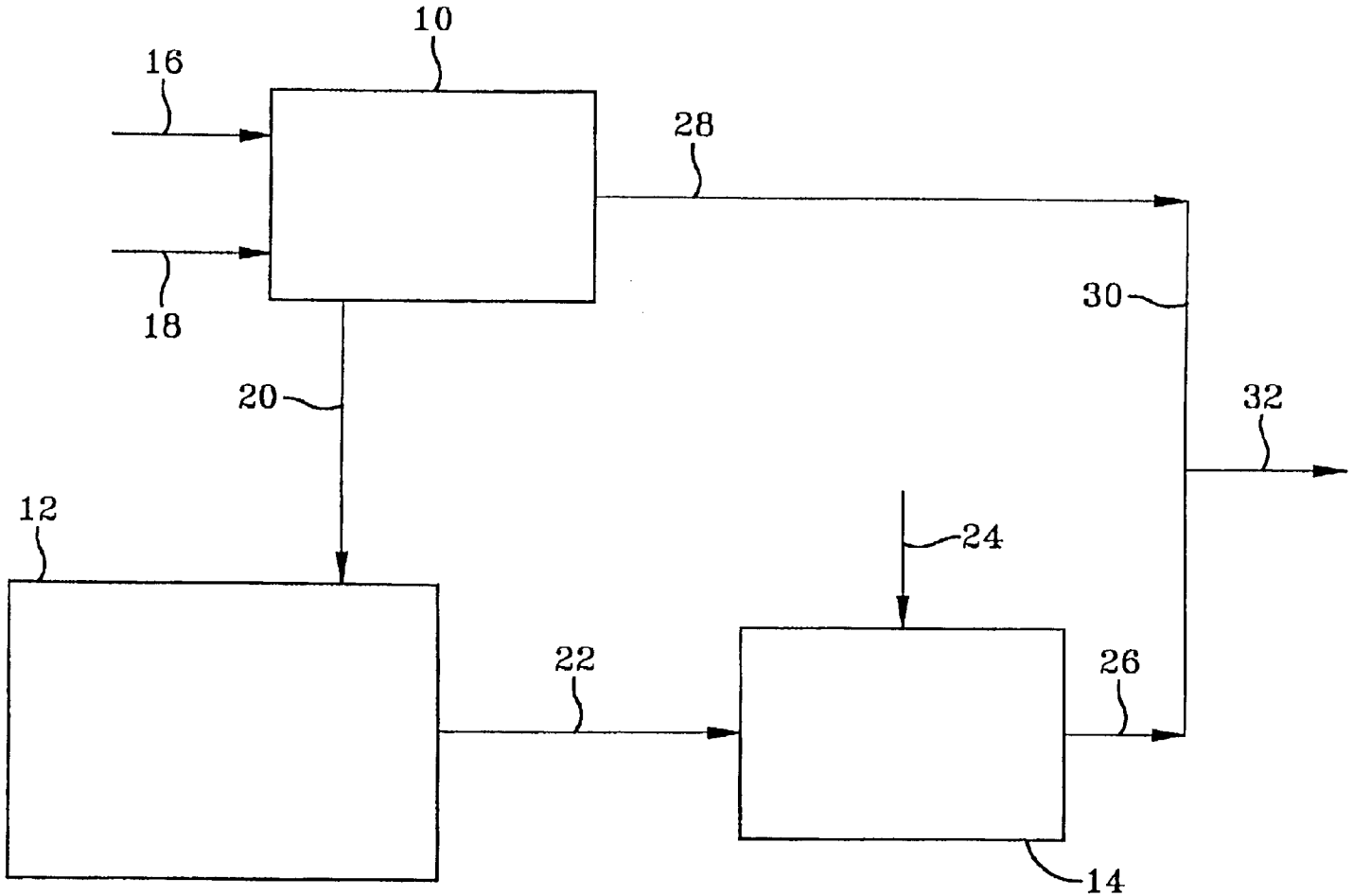
FIG. 1 is a simple block flow diagram of an integrated bitumen production and gas conversion process of the invention.

Liquid products, such as diesel fractions, resulting from upgrading bitumen are low in normal paraffins. As a consequence, the cetane number of diesel fractions recovered from bitumen upgrading typically ranges between about 35–45. While this may be sufficient for a heavy duty road diesel fuel, it is lower than desired for other diesel fuels. The bitumen-derived diesel fractions are therefore blended with blending components such as diesel fractions having a higher cetane number. Bitumen diesel fractions produced by coking the bitumen are hydrotreated to remove aromatics and metals and heteroatom compounds such as sulfur and nitrogen, to produce a treated diesel fraction useful as a blending stock. The higher cetane number diesel fraction produced from the gas conversion process is blended with one or more treated diesel fractions, to produce diesel fuel stocks. Diesel fuel is produced by forming an admixture of a suitable additive package and a diesel fuel stock. The term "hydrotreating" as used herein refers to processes wherein hydrogen or hydrogen in a hydrogen-containing treat gas reacts with a feed in the presence of one or more catalysts active for the removal of heteroatoms (such as sulfur and nitrogen), metals, saturation of aromatics and, optionally, saturation of aliphatic unsaturates. Such hydrotreating catalysts include any conventional hydrotreating catalyst, such as comprising at least one Group VIII metal catalytic component, preferably at least one of Fe, Co and Ni, and preferably at least one Group VI metal catalytic component, preferably Mo and W, on a high surface area support material, such as alumina and silica-alumina. Other suitable hydrotreating catalysts include zeolitic components. Hydrotreating conditions are well known and include temperatures and pressures up to about 450° C. and 3,000 psig, depending on the feed and catalyst. The bitumen is produced from tar sand which is a term used to describe a sandy sedimentary rock formation that contains a bitumen-like, extra heavy oil in quantities large enough for it to be economically produced and refined into more useful, lower boiling products. In the process of the invention, high and/or medium pressure steam, respectively obtained by cooling synthesis gas and the interior of the hydrocarbon synthesis reactor, is used to stimulate the bitumen production.

Upgrading the bitumen comprises fractionation and one or more conversion operations in which at least a portion of the molecular structure is changed, with or without the presence of hydrogen and/or a catalyst. The bitumen conversion comprises catalytic or non-catalytic cracking and hydroprocessing operations, such as hydrocracking, hydrotreating, and hydroisomerization, in which hydrogen is a reactant. Coking is more typically used for the cracking and cracks the bitumen into lower boiling material and coke, without the presence of a catalyst. It may be either delayed coking, fluid coking, or catalytic coking to produce lower boiling hydrocarbons and is followed by one or more hydroprocessing operations. Partial hydroprocessing may precede coking. The lower boiling hydrocarbons produced by coking, including diesel fractions, are reacted with hydrogen to remove metals, heteroatom compounds and aromatic compounds, as well as add hydrogen to the molecules. This requires a good supply of hydrogen, because these lower boiling hydrocarbons produced from the bitumen are high in heteroatom compounds (e.g., sulfur), and have a low hydrogen to carbon ratio (e.g., ~1.4–1.8).

The natural gas used to produce the synthesis gas will typically and preferably come from the bitumen field or a nearby gas well. Plentiful supplies of natural gas are typically found in or nearby tar sand formations. The high methane content of natural gas makes it an ideal natural fuel for producing synthesis gas. It is not unusual for natural gas to comprise as much as 92+ mole % methane, with the remainder being primarily $C_{2+}$ hydrocarbons, nitrogen and $CO_2$. Thus, it is an ideal and relatively clean fuel for synthesis gas production and plentiful amounts are typically found associated with or nearby tar sand formations. If necessary, heteroatom compounds (particularly HCN, $NH_3$ and sulfur) are removed to form a clean synthesis gas, which is then passed into a hydrocarbon synthesis gas reactor. While $C_2$–$C_5$ hydrocarbons present in the gas may be left in for synthesis gas production, they are typically separated for LPG, while the $C_{5+}$ hydrocarbons are condensed out and are known as gas well condensate. The methane-rich gas remaining after separation of the higher hydrocarbons, sulfur and heteroatom compounds, and in some cases also nitrogen and $CO_2$, is passed as fuel into a synthesis gas generator. Known processes for synthesis gas production include partial oxidation, catalytic steam reforming, water gas shift reaction and combination thereof. These processes include gas phase partial oxidation (GPOX), autothermal reforming (ATR), fluid bed synthesis gas generation (FBSG), partial oxidation (POX), catalytic partial oxidation (CPO), and steam reforming. ATR and FBSG employ partial oxidation and catalytic steam reforming. A review of these processes and their relative merits may be found, for example, in U.S. Pat. No. 5,883,138. Synthesis gas processes are highly exothermic and it is not uncommon for the synthesis gas exiting the reactor to be, for example, at a temperature as high as 2000° F. and at a pressure of 50 atmospheres. The hot synthesis gas exiting the reactor is cooled by indirect heat exchange with water. This produces a substantial amount of high pressure (e.g., 600–900/2000 psia) steam at respective temperatures of about 490–535/635–700° F., which may be heated even further. This steam may be passed down into a tar sand formation (with compression if necessary), to heat, soften and reduce the viscosity of the bitumen, and thereby stimulate the bitumen production. Both the synthesis gas and hydrocarbon production reactions are highly exothermic. Water used to cool the hydrocarbon synthesis reactor typically produces medium pressure steam and this may be used for bitumen production or other operations in the overall process of the invention.

The synthesis gas, after cleanup if necessary, is passed into a hydrocarbon synthesis reactor in which the $H_2$ and CO react in the presence of a Fischer-Tropsch type of catalyst to produce hydrocarbons, including light and heavy fractions. The light (e.g., 700° F.–) fraction contains hydrocarbons boiling in the diesel fuel range. A diesel fuel fraction may boil within and including a range as broad as 250–700° F., with from 350–650° F. preferred for some applications. The 500–700° F. synthesized diesel fuel hydrocarbons are the highest in cetane number, pour point and freeze point, while the lighter, ~500° F.– portion is relatively higher in oxygenates, which impart good lubricity to the diesel fuel. Hydroisomerizing the lighter diesel material will remove the oxygenates, while hydroisomerizing the higher material to reduce its pour and freeze points may reduce the cetane number. Therefore, at least the 500–700° F. diesel fraction produced by the synthesis gas is mildly hydroisomerized to reduce its pour point, while minimizing reduction in cetane number. Mild hydroisomerization is typically achieved under conditions of temperature and pressure of from about 100–1500 psig and 500–850° F. This is known and disclosed in, for example, U.S. Pat. No. 5,689,031 the disclosure of which is incorporated herein by reference. The cetane number of a diesel fraction produced by a Fischer-Tropsch gas conversion process hydrocarbon product may, after mild hydroisomerization, be 65–75+, with most of the high cetane material present in the higher boiling, 500–700° F. hydrocarbons. When maximum diesel production is desired, all or most of the gas conversion diesel fraction, and at least the cetane-rich heavier diesel fraction (e.g., 500/550–700° F.) produced by the gas conversion, will be blended with a hydrotreated diesel fraction produced from the bitumen. For maximum diesel production in the process of the invention, the heavy (e.g., ~700° F.+) hydrocarbon fraction produced from the synthesis gas is hydroisomerized to produce more hydrocarbons boiling in the diesel fuel range.

The table below illustrates a typical hydrocarbon product distribution, by boiling range, of a slurry Fischer-Tropsch hydrocarbon synthesis reactor employing a catalyst comprising a cobalt catalytic component on a titania-containing silica and alumina support component.

| Wt. % Product Distribution from Slurry Hydrocarbon Synthesis Reactor | |
|---|---|
| IBP($C_5$)–320° F. | 13 |
| 320–500° F. | 23 |
| 500–700° F. | 19 |
| 700–1050° F. | 34 |
| 1050° F.+ | 11 |

As the data in the table show, the overall diesel fraction is greater than 42 wt. %. The 500–700° F. high cetane fraction is 19 wt. % of the total product, or more than 45 wt. % of the total possible diesel fraction. While not shown, the total ($C_{5-400}$° F.) fraction is from about 18–20 wt. % of the total product. For maximum diesel production, the 700° F.+ waxy fraction is converted to hydrocarbons to hydrocarbons boiling in the middle distillate range. Those skilled in the art know that hydroisomerizing the 700° F.+ waxy fraction includes mild hydrocracking (c.f., U.S. Pat. No. 6,080,301 in which hydroisomerizing the 700° F.+ fraction converted 50% to lower boiling hydrocarbons). Thus, if desired all or a portion the higher 700° F.+ fraction may be hydrocracked and hydroisomerized to produce additional diesel material. The invention will be further understood with reference to the Figures.

Referring to FIG. 1, a gas conversion plant 10 is located over, adjacent to or proximate to a bitumen production facility 12, which produces bitumen from an underground formation and passes it, via line 22, to a bitumen upgrading facility 14. Production facility 12 comprises an underground tar sand formation and means (not shown) for injecting steam down into the formation, pumping out the softened bitumen, and separating gas and water from the produced bitumen. Typically the bitumen will then be diluted with a compatible diluent and then be transported to the upgrading facility by pipeline. A methane-containing natural gas and air or oxygen are respectively passed into the gas conversion plant via lines 16 and 18. The gas conversion plant produces synthesis gas and then converts the synthesis gas into heavy and light hydrocarbons in at least one or two hydrocarbon synthesis reactors. The light hydrocarbons include hydrocarbons boiling in the diesel range. The gas conversion plant also produces high and medium pressure steam, water, a tail gas useful as fuel and, optionally hydrogen. High pressure steam from the gas conversion plant is passed down into the tar sand formation via line 20 to stimulate the bitumen production. A high cetane diesel fraction is removed from the gas conversion plant via line 28 and passed to line 30. In the upgrading facility, the bitumen is upgraded by fractionation, coking and hydrotreating to produce a diesel fraction that is removed and passed via line 26, to line 30. The higher cetane gas conversion diesel fraction and the lower cetane bitumen diesel mix in 30 to form a mixture of both diesel fractions. This mixture is passed, via line 32, to tankage (not shown) as a diesel stock. Hydrogen for the hydrotreating is passed into 14 via line 24. Other process streams are not shown for the sake of simplicity.

Figure 2:
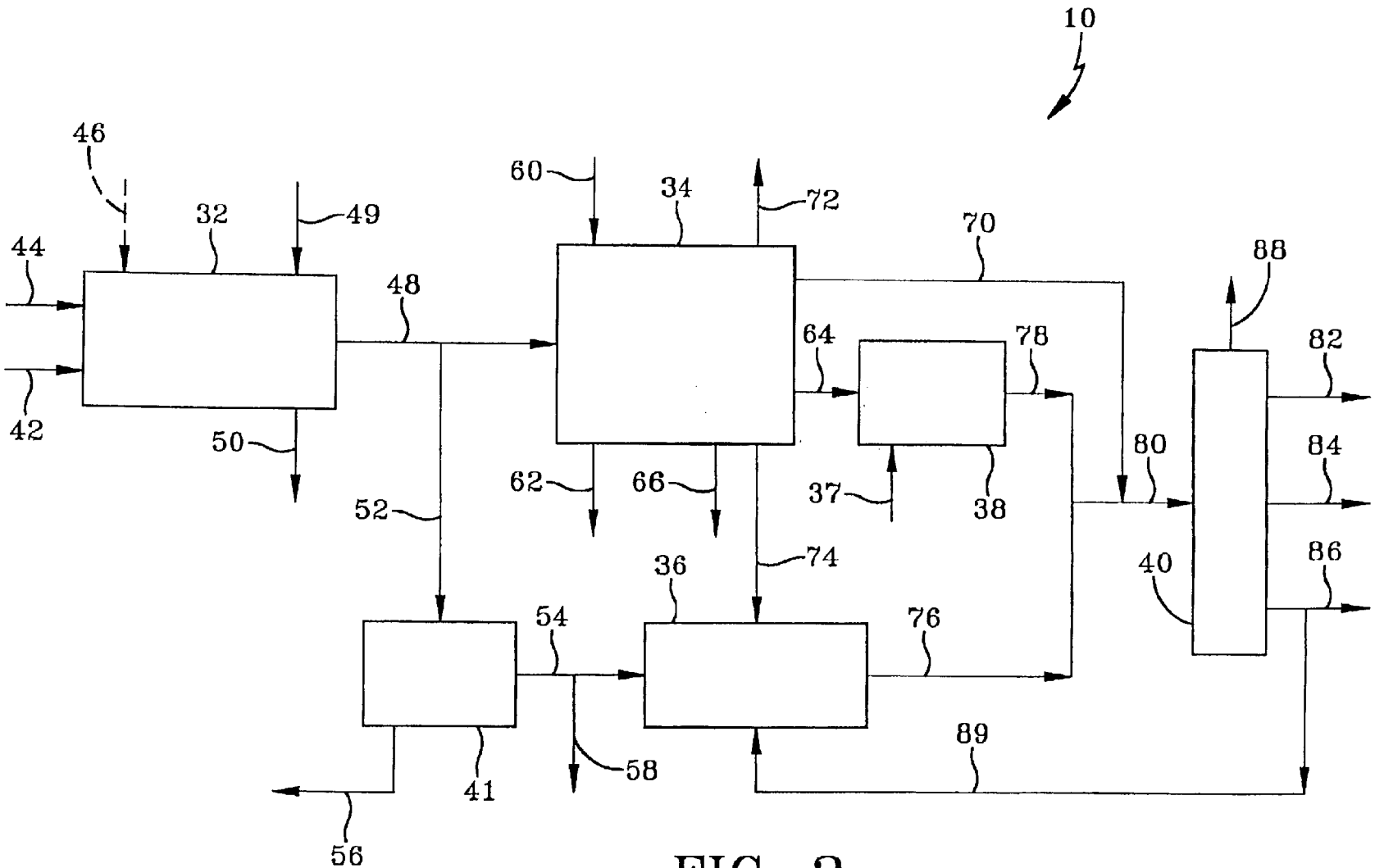
FIG. 2 is a flow diagram of a gas conversion process useful in the practice of the invention.

Turning now to FIG. 2, in this embodiment the gas conversion plant 10 comprises a synthesis gas generating unit 32, a hydrocarbon synthesis 34 comprising at least one hydrocarbon synthesis reactor (not shown), a heavy hydrocarbon fraction hydroisomerizing unit 36, a diesel fraction hydroisomerizing unit 38, a fractionating column 40 and a hydrogen producing unit 41. Natural gas that has been treated to remove heteroatom compounds, particularly sulfur, and $C_2$–$C_{3+}$ hydrocarbons, is passed into the synthesis gas generator 32, via line 42. In a preferred embodiment, the natural gas will have been cryogenically processed to remove nitrogen and $CO_2$, in addition to the heteroatom compounds and $C_2$–$C_{3+}$ hydrocarbons. Oxygen or air, and preferably oxygen from an oxygen plant is fed into the synthesis gas generator via line 44. Optionally, water or water vapor is passed into the synthesis gas generator via line 46. The hot synthesis gas produced in the generator is cooled by indirect heat exchange (not shown), with water entering the unit via line 49. This produces high pressure steam, all or a portion of which may be passed, via line 50, to the bitumen producing facility to stimulate the bitumen production. The pressure and temperature of this steam may be as high as 2000/2200 psia and 635/650° F. This steam may be further heated prior to being used for the bitumen production. The cool synthesis gas is passed from unit 32 into hydrocarbon synthesis unit 34, via line 48. A slip stream of the synthesis gas is removed via line 52 and passed into a hydrogen production unit 41, in which hydrogen is produced from the gas and passed, via line 54, into the heavy hydrocarbon hydroisomerization unit 36. In unit 41, hydrogen is produced from the synthesis gas by one or more of (i) physical separation means such as pressure swing adsorption (PSA), temperature swing adsorption (TSA) and membrane separation, and (ii) chemical means such as a water gas shift reactor. If a shift reactor is used due to insufficient capacity of the synthesis gas generator, physical separation means will still be used to separate a pure stream of hydrogen from the shift reactor gas effluent. Physical separation means for the hydrogen production will typically be used to separate the hydrogen from the synthesis gas, irrespective of whether or not chemical means such as a water gas shift reaction is used, in order to obtain hydrogen of the desired degree of purity (e.g., preferably at least about 90%). TSA or PSA which use molecular sieves can produce a hydrogen stream of 99+% purity, while membrane separation typically produces at least 80% pure hydrogen. In TSA or PSA the CO rich offgas is sometimes referred to as the adsorption purge gas, while for membrane separation it is often referred to as the non-permeate gas. In a preferred embodiment the synthesis gas generator produces enough synthesis gas for both the hydrocarbon synthesis reaction and at least a portion of the hydrogen needed for hydroisomerization by physical separation means, so that a water gas shift reactor will not be needed. Producing hydrogen from the synthesis gas using physical separation means provides relatively pure hydrogen, along with an offgas that comprises a hydrogen depleted and CO rich mixture of $H_2$ and CO. This CO rich offgas is removed from 41 via line 56 and used as fuel or fed into the hydrocarbon synthesis unit 34. If feasible, when hydrogen is produced from the synthesis gas, it is preferred that the mole ratio of the $H_2$ to CO in the gas be greater than stoichiometric, with at least a portion of the CO rich offgas passed back into line 48, via line 56. It is particularly preferred that the process be adjusted so that the CO rich offgas passed back into the hydrocarbon synthesis reactor be sufficient to adjust the $H_2$ to CO mole ratio in the syntheses gas passing into 34 to about stoichiometric. This avoids wasting the valuable CO by burning it as fuel. Hydrogen production from synthesis gas by one or more of (PSA), (TSA), membrane separation, or a water gas shift reaction is known and disclosed in U.S. Pat. Nos. 6,043,288 and 6,147,126. In another preferred embodiment, a portion of the separated hydrogen is removed from line 54, via line 58, and passed to one or more of (i) the bitumen upgrading facility if it is close enough, to provide reaction hydrogen for hydroconversion of the bitumen and particularly hydrotreating of the bitumen diesel fraction, (ii) hydroisomerization unit 38 for mild hydroisomerization of at least the heavy gas conversion diesel fraction, to reduce its pour point with minimal effect on the cetane number, and preferably at least to unit 38. In the hydrocarbon synthesis reaction unit 34, the $H_2$ and CO in the synthesis gas react in the presence of a suitable hydrocarbon synthesis catalyst, preferably one comprising a supported cobalt catalytic component, to produce hydrocarbons, including a light fraction and a heavy fraction. The synthesis reaction is highly exothermic and the interior of the reactor must be cooled. This is accomplished by heat exchange means (not shown) such as tubes in the reactor, in which cooling water maintains the desired reaction temperature. This converts the cooling water typically to medium pressure steam having a pressure and temperature of, for example, from 150–600 psia and 250–490° F. Thus cooling water enters the unit via line 60, cools the interior of the synthesis reactor (not shown) and turns to medium pressure steam which is passed out via line 62. All or a portion of this steam may also be used for bitumen production; for utilities in the gas conversion process, for fractionation, etc. If the bitumen upgrading facility is close enough, all or a portion of this steam may be passed to the bitumen upgrading unit, where it may be used for power generation, to supply heat for fractionation, to lance coke out of a coker, etc. It is preferred to heat this medium pressure to a superheat quality, before it is used for bitumen production. The heavy hydrocarbon fraction (e.g., 700° F.+) is removed from 34 via line 74 and passed into hydroisomerization unit 36 in which it is hydroisomerized and mildly hydrocracked. This converts some of the heavy hydrocarbons into lower boiling hydrocarbons, including hydrocarbons boiling in the diesel range. The lighter hydrocarbon fraction (700° F.–) is removed from 34 via line 64 and passed into a mild hydroisomerization unit 38. Hydrogen for the hydroisomerization reaction enters 38 via line 37. This lighter fraction may or may not include the 500° F.– hydrocarbons of the total diesel fraction, depending on whether or not it is desired to retain the oxygenates in this fraction (c.f., U.S. Pat. No. 5,689,031). The gaseous products of the hydrocarbon synthesis reaction comprise $C_2$–$C_{3+}$ hydrocarbons, including hydrocarbons boiling in the naphtha and lower diesel boiling ranges, water vapor, $CO_2$ and unreacted synthesis gas. This vapor is cooled in one or more stages (not shown), during which water and $C_2$–$C_{3+}$ hydrocarbons condense and are separated from the rest of the gas, and passed out of the reactor via line 64. The water is withdrawn via line 66 and the liquid, light hydrocarbons via line 70. These light hydrocarbons include hydrocarbons boiling in the naphtha and diesel ranges, and are passed to line 80. The water may be used for cooling, including cooling the hot synthesis gas, for steam generation and the like. The remaining uncondensed gas comprises mostly methane, $CO_2$, minor amounts of $C_{3-}$ light hydrocarbons, and unreacted synthesis gas. This gas is removed via line 72 and used as fuel to heat boilers for making and heating steam for power generation, bitumen stimulation, upgrading, and the like. All or a portion of the water removed via line 66 may also be heated to make steam for any of these purposes and, if a plentiful source of suitable water is not available, then preferably for at least cooling the hot synthesis gas to produce high pressure steam for the bitumen production. The hydroisomerized heavy fraction is removed from 36 via line 76 and passed to line 80. The mildly hydroisomerized diesel material is removed from 38 via line 78 and passed into line 80, where it mixes with the hydroisomerized heavy fraction. This mixture, along with the condensed light hydrocarbons from line 70 pass into fractionater 40. The fractions produced in 40 include a naphtha fraction 82, a diesel fraction 84 and a lube fraction 86. Any $C_{3-}$ hydrocarbons present in the fractionater are removed via line 88 and used as fuel. Optionally, all or a portion of the lube fraction may be recycled back into the hydroisomerizing unit 36 via line 89, in which it is converted into hydrocarbons boiling in the diesel range, to increase the overall diesel production.

Figure 3:
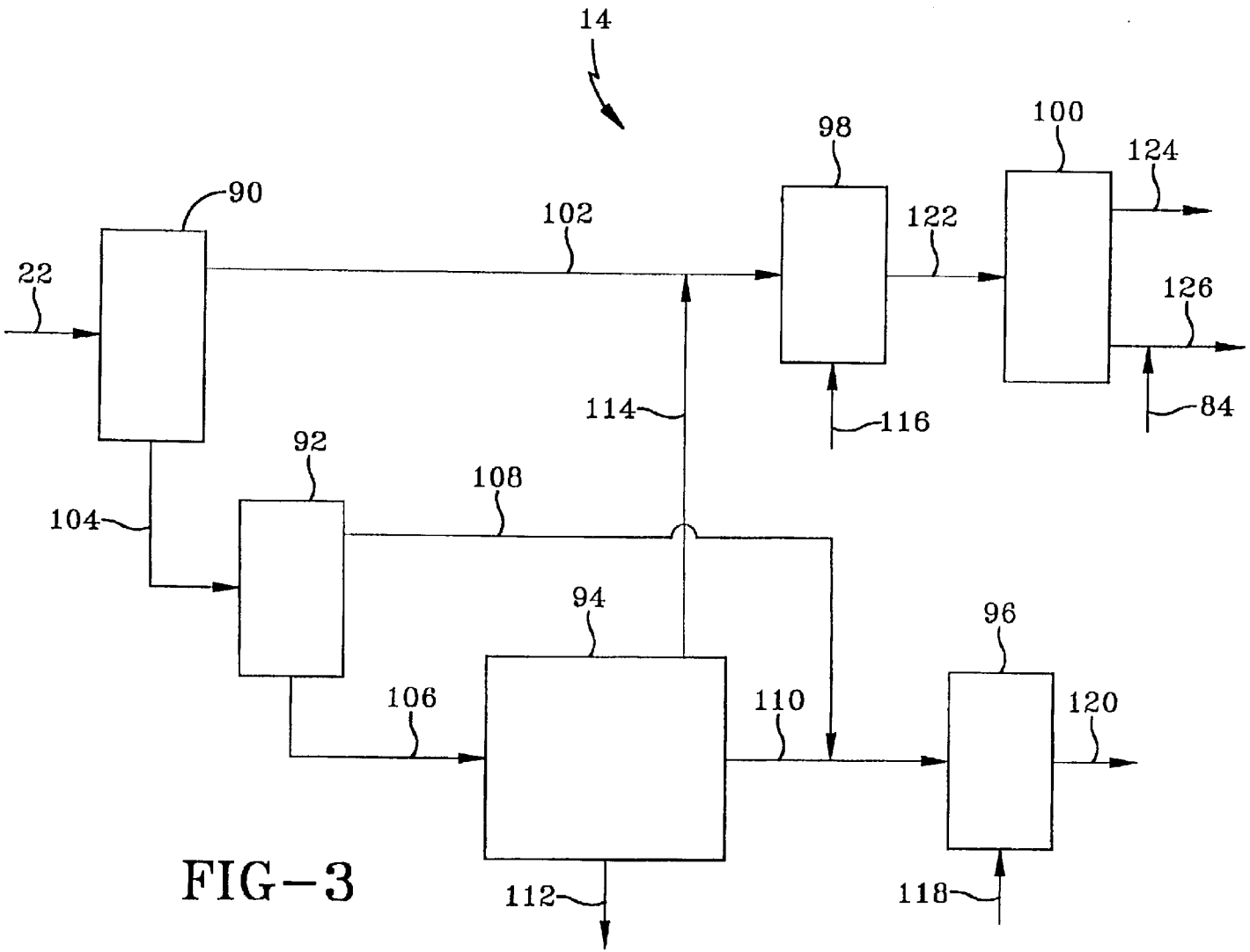
FIG. 3 is a block flow diagram of a bitumen upgrading process useful in the practice of the invention.

An embodiment of a bitumen upgrading facility 14 useful in the practice of the invention is shown in FIG. 3 as comprising an atmospheric pipe still 90, a vacuum fractionater 92, a fluid coker 94, a gas oil hydrotreater 96, a combined naphtha and middle distillate hydrotreater 98 and a distillate fractionater 100. Bitumen is passed, via line 22, from the bitumen production facility into atmospheric pipe still 90. In fractionater 90, the lighter 650–750° F.– hydrocarbons are separated from the heavier 650–750° F.+ hydrocarbons and passed, via line 102 to hydrotreater 98. The 650–750° F.+ hydrocarbons are passed to vacuum fractionater 92, via line 104. In 92, the heavier fraction produced in 90 is separated into a 1000° F.– heavy gas oil fraction and a 1000° F.+ bottoms. The bottoms is passed into fluid coker 94, via line 106 and the heavy gas oil fraction passed into gas oil hydrotreater 96, via lines 108 and 110. Fluid coker 94 is a noncatalytic unit in which the 1000° F.+ fraction contacts hot coke particles, which thermally crack it to lower boiling hydrocarbons and coke. The coke is withdrawn from the bottom of the coker via line 112. While not shown, this coke is partially combusted to heat it back up to the bitumen cracking temperature of about 900–1100° F. This consumes part of the coke and the remaining hot coke is passed back into the coker, to provide the heat for the thermal cracking. The lower boiling hydrocarbons produced in the coker comprise naphtha, middle distillates and a heavy gas oil. These lower boiling hydrocarbons, which include the 700° F.– hydrocarbons boiling in the desired diesel range, are passed, via line 114 and 102, into hydrotreater 98. The 700° F.+ gas oil is passed into gas oil hydrotreater 96, via line 110. Hydrogen or a hydrogen containing treat gas is passed into the hydrotreaters via lines 116 and 118. In the hydrotreaters, the hydrocarbons react with the hydrogen in the presence of a suitable sulfur and aromatics resistant hydrotreating catalyst, to remove heteroatom (e.g., sulfur and nitrogen) compounds, unsaturated aromatics and metals. The gas oil fraction contains more of these undesirable compounds than the distillate fuels fraction and therefore requires more severe hydrotreating. The hydrotreated gas oil is removed from hydrotreater 96 and passed, via line 120, to storage for transportation or to further upgrading operations. The hydrotreated 700° F.– hydrocarbons pass from hydrotreater 98 into fractionater 100, via line 122, in which they are separated into light naphtha and diesel fractions. The naphtha is removed via line 124 and the diesel via line 126. The higher cetane diesel from the gas conversion facility is passed into line 126 from line 84 to form a mixture of the two, to produce a diesel fuel stock having a higher cetane number than the bitumen diesel fraction removed from fractionater 100. This blended diesel fuel stock is sent to storage.

Hydrocarbon synthesis catalysts are well known and are prepared by compositing the catalytic metal component(s) with one or more catalytic metal support components, which may or may not include one or more suitable zeolite components, by ion exchange, impregnation, incipient wetness, compositing or from a molten salt, to form the catalyst precursor. Such catalysts typically include a composite of at least one Group VIII catalytic metal component supported on, or composited with, with at least one inorganic refractory metal oxide support material, such as alumina, amorphous, silica-alumina, zeolites and the like. The elemental Groups referred to herein are those found in the Sargent-Welch Periodic Table of the Elements, © (1968 by the Sargent-Welch Scientific Company. Catalysts comprising a cobalt or cobalt and rhenium catalytic component, particularly when composited with a titania component, are known for maximizing aliphatic hydrocarbon production from a synthesis gas, while iron catalysts are known to produce higher quantities of aliphatic unsaturates. These and other hydrocarbon synthesis catalysts and their properties and operating conditions are well known and discussed in articles and in patents.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A process for producing a diesel fuel fraction from bitumen comprises (i) stimulating the production of bitumen with steam obtained from a natural gas fed gas conversion process that produces a diesel hydrocarbon fraction and steam, (ii) upgrading said bitumen to lower boiling hydrocarbons, including a diesel fraction, and (iii) forming a mixture of both said diesel fractions.

2. A process according to claim 1 wherein diesel fraction produced by said gas conversion has a cetane number higher than that of said diesel fraction produced from said bitumen.

3. A process according to claim 2 wherein said steam comprises at least one of (i) high pressure steam and (ii) low pressure steam.

4. A process according to claim 3 wherein said diesel fraction produced from said bitumen contains heteroatom and unsaturated aromatic compounds.

5. A process according to claim 4 wherein said fraction produced from said bitumen is treated to reduce the amount of said heteroatom and unsaturated aromatic compounds.

6. A process according to claim 5 wherein said treatment occurs prior to said mixing.

7. A process according to claim 6 wherein said treatment comprises hydrotreating.

8. A process for producing a diesel fuel fraction from bitumen comprises the steps of (i) producing bitumen with steam stimulation, (ii) upgrading said bitumen to lower boiling hydrocarbons, including a sulfur-containing bitumen diesel fraction, (iii) treating said bitumen diesel fraction to reduce said sulfur content, and (iv) producing steam and hydrocarbons, including a diesel fraction, by means of a natural gas fed gas conversion process, wherein at least a portion of said steam is used for said bitumen production, and (v) treating at least a portion of said gas conversion diesel fraction to reduce its pour point.

9. A process according to claim 8 wherein at least a portion of both said diesel fractions are blended.

10. A process according to claim 9 wherein at least a portion of both said diesel fractions are blended subsequent to said treating.

11. A process according to claim 10 wherein said bitumen diesel fraction has a cetane content lower than said diesel fraction produced by said gas conversion.

12. A process according to claim 11 wherein said blend has a cetane number higher than that of said bitumen diesel fraction.

13. A process according to claim 12 wherein said bitumen upgrading comprises coking and fractionation.

14. A process according to claim 13 wherein said treatments comprise hydroisomerizing said gas conversion diesel fraction and hydrotreating said bitumen diesel fraction.

15. A process according to claim 14 wherein said hydrotreating, in addition to sulfur removal, also reduces the amount of other heteroatoms, aromatic unsaturates and metals present in said untreated bitumen diesel fraction.

16. A process according to claim 15 wherein said gas conversion also produces water and a tail gas useful as fuel used to make steam from said water.

17. A process for producing a diesel fuel fraction from bitumen comprises:

(i) converting natural gas to a hot synthesis gas comprising a mixture of $H_2$ and CO which is cooled by indirect heat exchange with water to produce steam;

(ii) contacting said synthesis gas with a hydrocarbon synthesis catalyst in one or more hydrocarbon synthesis reactors, at reaction conditions effective for said $H_2$ and CO in said gas to react and produce heat, liquid hydrocarbons including a diesel fuel fraction, and a gas comprising methane and water vapor;

(iii) removing heat from said one or more reactors by indirect heat exchange with water to produce steam;

(iv) hydroisomerizing at least a portion of said diesel fraction to reduce its pour point;

(v) passing at least a portion of said steam produced in either or both steps (i) and (iii) into a tar sand formation to heat soak and reduce the viscosity of said bitumen;

(vi) producing said bitumen by removing it from said formation;

(vii) upgrading said bitumen to produce lower boiling hydrocarbons, including a diesel fuel fraction containing heteroatom compounds;

(viii) hydrotreating said bitumen diesel fuel fraction to reduce its heteroatom content, and (ix) combining at least a portion of each of said treated diesel fuel fractions.

18. A process according to claim 17 wherein said water vapor is removed from said gas to produce a fuel gas comprising methane and using said gas to further heat steam used for said bitumen stimulation.

19. A process according to claim 17 wherein said hydrogen is produced from said synthesis gas and used for said hydroisomerization.

20. A process according to claim 17 wherein said catalyst comprises a cobalt catalytic component.

* * * * *